US006616238B1

(12) United States Patent
Guery-Strahm

(10) Patent No.: US 6,616,238 B1
(45) Date of Patent: Sep. 9, 2003

(54) ERGONOMIC SEATING UNIT

(75) Inventor: Ruth Guery-Strahm, Leeacherstrasse 33, Ebmatingen (CH), CH-8123

(73) Assignee: Ruth Guery-Strahm, Ebmatingen (CH)

( * ) Notice: Subject to any disclaimer, the term of this patent is extended or adjusted under 35 U.S.C. 154(b) by 0 days.

(21) Appl. No.: 10/048,325

(22) PCT Filed: Sep. 1, 2000

(86) PCT No.: PCT/IB00/01227

§ 371 (c)(1),
(2), (4) Date: Jan. 30, 2002

(87) PCT Pub. No.: WO02/17751

PCT Pub. Date: Mar. 7, 2002

(30) Foreign Application Priority Data

Nov. 11, 1997 (IL) ..... 122172

(51) Int. Cl.[7] ..... A47C 4/54

(52) U.S. Cl. ..... 297/452.41; 297/440.1; 5/654

(58) Field of Search ..... 297/411.41, 452.41, 297/452.1, 440.1; 482/77; 472/134, 135; 248/562, 599; 5/654, 655.3

(56) References Cited

U.S. PATENT DOCUMENTS

| | | | | | |
|---|---|---|---|---|---|
| 3,476,497 | A | * | 11/1969 | Cashen et al. | 297/232 |
| 3,495,874 | A | * | 2/1970 | Dean | 297/452.17 |
| 3,635,528 | A | * | 1/1972 | Strom | 297/452.41 |
| 3,899,210 | A | * | 8/1975 | Samhammer et al. | 297/448.2 |
| 5,690,389 | A | * | 11/1997 | Ekman et al. | 297/452.41 |

FOREIGN PATENT DOCUMENTS

| | | | | |
|---|---|---|---|---|
| CH | 369558 | * | 7/1963 | 297/354.11 |
| DE | 4445476 | * | 6/1996 | |
| EP | 563820 | * | 10/1993 | |

* cited by examiner

*Primary Examiner*—Peter R. Brown

(57) ABSTRACT

An ergonomic seating unit is disclosed for promoting active and dynamic sitting and eliminating fatigue resulting from extended sitting. The seating unit comprises a substantially egg-shaped, or ball-shaped, fluid filled, deformable balloon forming a flexible, mobile seat which conforms to the shape of a user when sat upon, and a main frame for loosely containing the flexible balloon being freely removable from the main frame when the seating unit is unoccupied and being movably wedged in place by the main frame when the seat is occupied.

19 Claims, 2 Drawing Sheets

SECTION I - I

SECTION II - II

ERGONOMIC SEATING UNIT

CROSS REFERENCE TO RELATED APPLICATION

This is an improvement application of Swiss Patent Ser. No. CH 679444, Date of Patent: Feb. 28, 1992, U.S. Pat. No. 6,070,943, Date of Patent: Jun. 6, 2000 and Swiss Patent Ser. No. CH 690394, Date of Patent: Aug. 31, 2000.

BACKGROUND OF THE INVENTION

1. Field of the Invention

The present invention generally relates to an ergonomically designed seating unit which naturally exercises the body by providing active sitting and, more particularly, to such an ergonomically designed seating unit which employs a fluid-filled, substantially egg-shaped, or ball-shaped seat, which promotes continuous movement of the spine, hips and upper body.

2. Background Discussion

Increasingly, scholars, students and workers are required to spend prolonged periods seated at a learning place, or a workstation. As a result, the potential for back, shoulder and neck problems has considerably increased. This is particularly true when seated in a conventional chair having a rigid seat which, with prolonged use, restricts blood circulation to the legs and does not allow for constant small movements of the spine, hips and arms. These small movements, herein referred to as "active sitting" or "dynamic sitting", are especially beneficial in reducing or preventing pains in the upper body.

Children, while in growth, are especially endangered in this respect, and if not properly seated, can catch permanent damage to their body. To them the principle of "active sitting" applies therefore especially.

It is known to provide conventional students chairs or office chairs with mechanical arrangements for adjusting the seat height, seat position and backrest position. However, such mechanic devices need periodic servicing, are susceptible to breakage and require a good understanding of ergonomics for proper use. While ergonomically correct backrests, when applied to such students or office chairs, can substantially help to reduce back pain, they do not offer a solution to an event more frequent problem caused by tension and pain in the neck and shoulder area.

One proposed solution to address the above-noted problems associated with the conventional rigid-seat chair is the use of a gymnastics ball as a chair. The ball, typically made of plastic, is well suited for exercising, but does not have the required stability for prolonged use as a chair, nor necessarily the proper dimensions essential for office, school and/or other workstation labor. Users typically complain of the need to constantly balance their body on the ball which, if not properly carried out, can lead to accidents, such as falling off the ball.

Other proposed solutions are inflatable chairs, distribution of pressurized fluid to a seating unit, or other improvement to chairs and upholstered furniture. All those proposals offer only a limited horizontal and vertical movement, need air pumps or compressors, do not have castors and are generally not adapted for work at a desk or a table.

Thus, there is a need to provide an improved seating unit that ensures active sitting, optimal sitting position, stability, versatility, variability, mobility and simplicity, yet does not possess the shortcomings of the seating devices presently employed.

OBJECT OF THE INVENTION

It is therefore an object of the present invention to provide an improved seating unit that ensures active sitting, optimal sitting positions for use at a desk, table or workstation and imparts a feeling of stability to the user.

Yet another object of the present invention is to provide an improved seating unit which is adjustable to offer different sitting positions using an easy and simple arrangement which eliminates the need to utilize mechanical or electrical devices, such as hydraulic pistons, levers, air pumps, compressors, or similar devices.

A further object of the present invention is to provide an improved seating unit that can be mounted and dismounted easily and quickly and can thus be transported from one location to another.

Still another object of the present invention is to provide an improved seating unit that is versatile such that the seat of the improved seating unit can be used separately for purposes other than sitting, for example, for playing, gymnastics exercises, relaxation and other exercises.

Another object of the present invention is to provide an improved seating unit that has such a light weight that it can easily be carried from place to place. Yet another object of the present invention is to provide an improved seating unit that can be equipped with an elastic textile cover which adapts itself to the changing size of the seat, thus improving sitting comfort.

An important advantage of the present invention is that the user experiences continuously slight movements of the spine, the hips and the upper body. In this way, pains and tensions caused by a rigid sitting position can be prevented.

Another advantage of the present invention is that the sitting position can be customized and individually tailored for an individuals user by inflating the balloon by mouth, or deflating it by hand, or changing the position of the armrest, or of the sliding base to the balloon, without the need for any mechanical or electric devices. The balloon is held firmly in place by the surrounding connecting elements as soon as the user sits on it and exerts pressure on the seat.

Yet another advantage of the present invention is that it grants the user the known advantages of active and dynamic sitting and at the same time, owing to the rigid frame, the sensation of stability, essential for comfortable, prolonged sitting. Still another advantage of the present invention is that by providing a soft seat, which automatically adjusts itself to fit exactly to the body shape of the user, pains connected with lower body distress are reduced. Since the soft seat has no edges, blood circulation in the legs is not hindered by the soft seat.

Yet another advantageous feature of the present invention is that the elastic cover is fitted tightly to the balloon and, by dividing between the user's body and the seat surface, reduces perspiration under hot conditions.

Another advantage of the present invention is that the seat surface can be taken out of the seat simply and quickly by hand and used for other purposes, like a toy for children, or gymnastics and other exercises. Afterwards it can be placed back easily in the frame serving as a seat again.

Still another advantage of the present invention is that it is durable and completely free of maintenance.

Yet another advantage of the present invention is that it can be easily and quickly assembled and disassembled into its small and flat components. In this way the transport from one location to another is made very easy and convenient.

These and other objects, advantages and features of tho present invention are achieved, according to one embodiment thereof, by an ergonomic seating unit comprising a main frame having a rigid side frame and a stable bottom frame equipped with a sliding base in which a mobile seat is inserted. The mobile seat can be moved significantly in all directions when the chair is occupied, the mobile seat comprising an inflated ball shaped balloon formed of, for example a rubber or thermoplastic material.

The frame is formed, for example, of steel or other suitable metals and comprises: 1) an oval or U shaped upper frame, which can be surrounded by upholstery, and serves as backrest and armrest, 2) a round or star shaped lower frame equipped with traversal tubes or a sliding base for the seat surface and 3) vertical tubes which connect the upper frame to the lower frame. The whole structure is held together by suitable fasteners, such as for example bolts or screws or the like. An additional flexible backrest, possessing a rectangular or oval shape can be attached to the middle vertical connecting tube. This flexible backrest is also adjustable horizontally and vertically.

The foregoing and other objects, advantages and features of the present invention will no doubt become more apparent to those skilled in the art after having read the following detailed description of the preferred embodiments of the present invention, which are contained and illustrated by the various Drawing Figures.

DETAILED DESCRIPTION OF THE PREFERRED EMBODIMENT(S)

Figure 1:
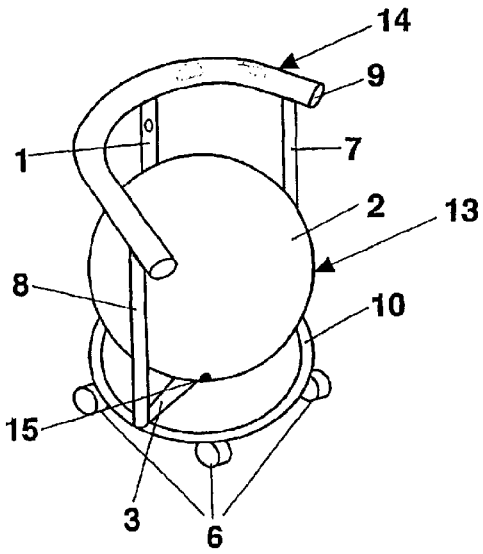
FIG. 1 is a perspective view illustrating a complete seat unit constructed in accordance with the mentioned improvements of the present invention.
Figure 2:
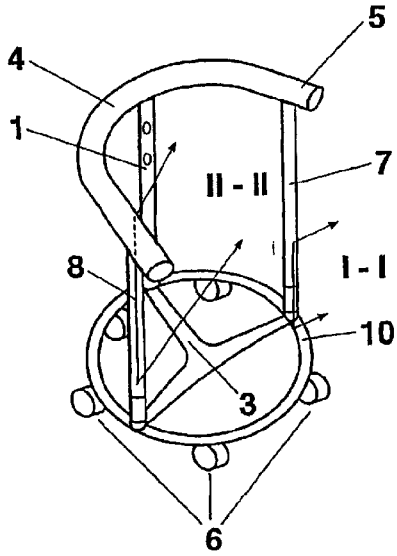
FIG. 2 is a perspective view revealing the complete frame of the seat unit illustrated in FIG. 1.

Referring now to FIG. 1 and FIG. 2, one embodiment of ergonomic seating unit of the present invention, generally indicated as 13, is illustrated. The ergonomic seating unit includes a main frame, at 14, comprising for example a metal construction, made of anodized or coated metal tubes. The main frame 14 comprises a circular lower frame 10 equipped with castors or glides 6, a sliding base for the seat surface 3, an upper frame 4 padded with foam, rubber or similar material 9, and vertical tubes 1, 7 and 8, which connect the lower and upper frames 4, 10 respectively to one another. As best seen in FIGS. 1 and 2, the vertical tubes are also hosting the sliding base for the seat surface, which is fixed to the vertical tubes 1, 7 and 8 by the means of 3 bolts or screws.

The seating unit 13 further includes a egg-shaped, or ball-shaped inflated rubber or plastic balloon 2 serving as the seat surface. When the user sits on balloon 2, pressure is exerted by his body weight on the balloon 2 which expands sideways, thereby wedging itself firmly within the cage formed space delineated by the connecting tubes 1, 7 and 8 and the sliding base for the seat surface 3. When the user stands up, pressure is relieved and the balloon 2 assumes its original egg-shape or ball-shape. As a result, the balloon 2 can be easily removed from the main frame 14 and used for other purposes, such as, for example, playing or exercising.

Figure 3:
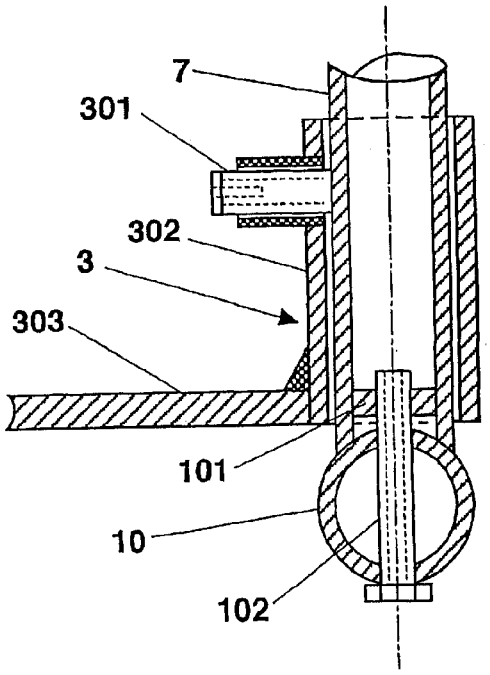
FIG. 3 is an axial, partial cross-section view illustrating the connection between the horizontal tube of the lower frame, the vertical connecting tube and the sliding base for the seat surface.

Connected to the circular lower frame 10 is the sliding base for the seat surface 3, which is bolted to the vertical tubes 1, 7 and 8, as best seen in FIG. 2, and FIG. 3. The circular lower frame 10 is equipped with, for example at least five castors or glides 6, providing mobility, the castors or glides 6 bolted to frame 10, so the castors or glides 6 can be easily dismounted, allowing for easy replacement or transport of the seating unit 13. The castors 6 may be all equipped with brakes or be without brakes or be a mixture of both types, depending on the friction of the floor applied, thus minimizing accident risk.

Figure 4:
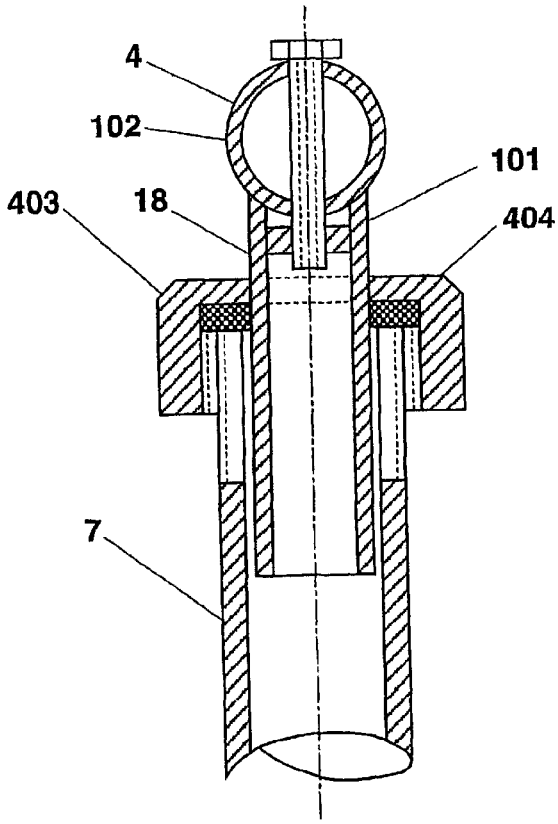
FIG. 4 is an axial, partial cross-section view illustrating the connection between both parts of a vertical connecting tube, constructed as a telescopic tube with variable length.
Figure 5:
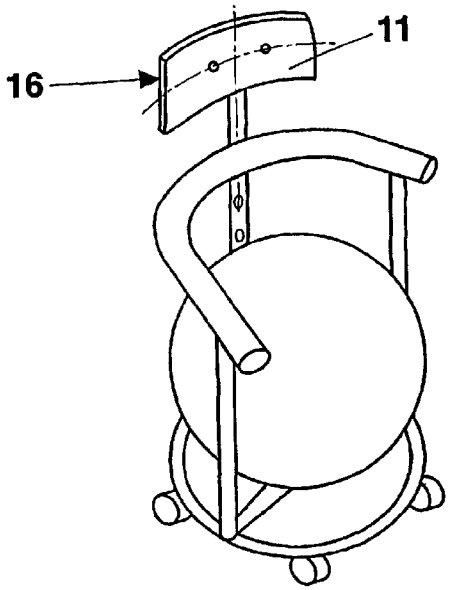
FIG. 5 is a perspective view illustrating a complete seat unit constructed in accordance with the mentioned improvements of the present invention and equipped with an additional flexible backrest.

As best seen in FIGS. 3 and 4, the connecting tubes 1, 7 and 8 are fixed to the lower frame 10 and the upper frame 4, respectively by bolts 102. Each of the connecting tubes 1, 7 and 8 has, at the top and the bottom thereof, an insert 101, that is pressed, rolled or welded into the tubes. The holes for the bolts 102 are punched at the top of the upper frame 4 and the bottom of the lower frame 10 in order to sink the head of the bolt 102 into the tube of the upper frame 4 and the bottom of the lower frame 10 in order to sink the head of the bolt 102 into the tube of the lower frame 10 and the tube of the upper frame 4.

The seating unit 13 can be fitted optimally to the size and measurements of the user by providing it with different sized balloons 2 and changing the length of the connecting tubes 1, 7 and 8, or, as a variance, providing a telescopic tube arrangement as best seen in FIG. 4. With the said arrangement tube 18 slides within the connecting tubes 1, 7 and 8 vertically. Tube 18 is equipped with a nut 403, having an insert for example made of rubber or thermoplastic material 404. When nut 403 is tightened on the connecting tubes 1, 7 and 8 respectively, the insert 404 tightens tube 18 by friction and the upper frame 4 is fixed at a certain requested height according to the size and measurements of the user. Balloon 2 possesses a simple plug 15 inserted in a hole at its bottom and can be inflated easily by mouth. When inflating, the plug 15 is pulled out of the hole and inserted again, when the desired pressure in the balloon 2 is reached. By inflating the balloon 2 to a desired pressure, the sitting height, as well as the softness of the seat formed by the balloon 2 of the seating unit 13, is adjusted until the optimal position for the user is provided.

Deflating balloon 2 occurs in the opposite way to the description before. The plug 15 is pulled out of the hole, air is let out and the plug 15 is inserted again, when the desired pressure in the balloon 2 is reached, again to reach the optimal sitting position for the user. Balloon 2 can also be inflated analogously by mechanical or electrical devices, like an air pump, or compressor, if preferred.

In an occupied state, the top of the balloon 2 adapts itself exactly to the body shape of the sitting person, preventing sharp edges, thus providing optimal blood circulation in the legs of the user. Further the balloon 2 automatically provides in an occupied condition of the seating unit 13, significant, yet controlled movements in all directions. However, upper frame 4 limits these movements, thus providing the user with the feeling of stability.

Pad 9 of upper frame 4 is made, for example of a hollow tube of foam rubber or similar material which is split along the underside, so that it can be easily mounted by pushing it down onto frame 4. The pad 4 can be covered by textile, leather or plastic materials of various qualities and patterns, thus fitting the upper frame 4 to the comfort demands of the user. The pad 9 can also be easily removed, or replaced by another pattern or quality, by simply pulling it away from frame 4.

By removing the six bolts 102, the whole sitting unit 13 can be easily and quickly disassembled into flat and light components, thus allowing for easy transportation to other locations.

Figure 6:
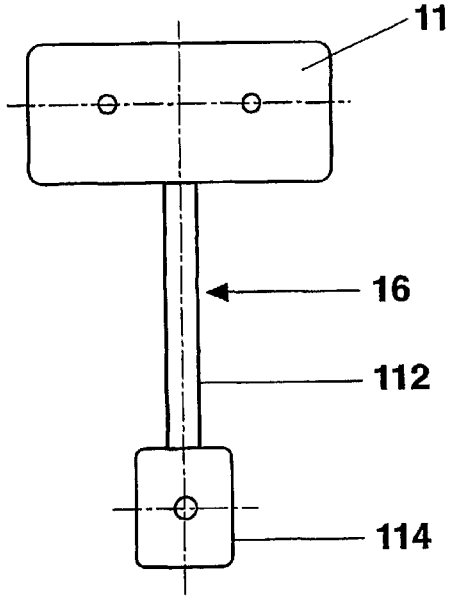
FIG. 6 is a schematic front view of an additional flexible backrest.
Figure 7:
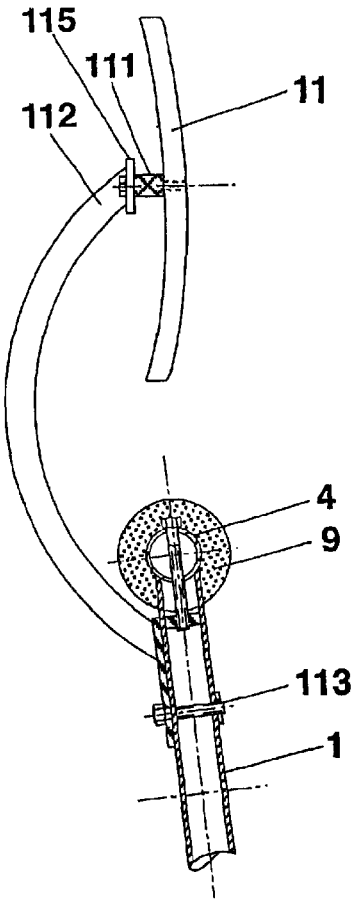
FIG. 7 is a schematic side elevation view of an additional flexible backrest connected to the middle vertical tube contained in FIG. 2.

Referring now to FIG. 6 and FIG. 7, an additional flexible backrest, generally seen at 16, is shown which comprises an arched rectangular or oval shaped support 11, connected to arm 112 by one or more elastic dampers 111, the damper 111 being made of rubber or similar material, which allow for horizontal movement in all directions of support 11.

Elastic damper is fixed to support 11 and arm 112 by, for example, a bolt and nut combination. The damper 111 can also be riveted to support 11. As best seen in FIG. 7, the arm 112 is provided with a vertical upper plate 115 equipped with one or more holes utilized to connect arm 112 to damper(s) 111. Arm 112 also possesses a vertical bottom plate 114 that is equipped with a hole, allowing the arm 112 to be connected by bolt 113 to vertical tube 1. The vertical tube 1 has several horizontal holes drilled into it thus allowing for various height adjustment positions of support 11.

As a variance, the height of support II can be adjusted by a conventional vertical slide, used with office chairs, the slide connected to arm 112 or to vertical tube 1. Support 11 can be manufactured of different materials, such as, for example, wood, plywood, plastic or metal and can be furnished in upholstered version.

Figure 8:
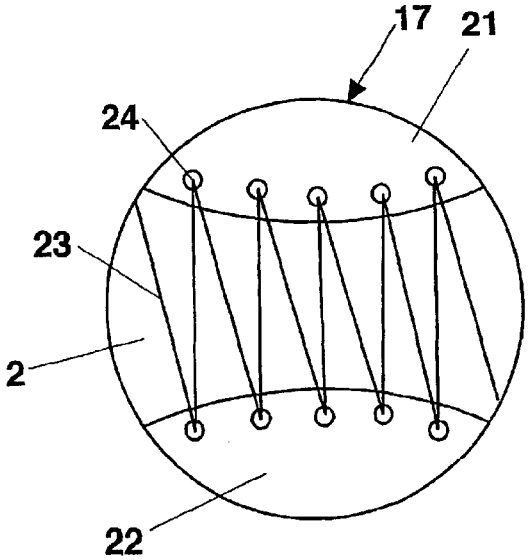
FIG. 8 is a schematic front view of an elastic seat cover.

Referring now to FIG. 8, a cover, generally shown at 17 for covering at least the sitting surface of the ball shaped balloon 2 comprises a round top panel 21 and a round bottom panel 22. The panels 21, 22 are connected to one another and secured by one or more elastic strings 23. Top panel 21 serves as an addition to the sitting surface of balloon 2, separating the rubber or plastic material of balloon 2 from the body of the user, thus reducing perspiration and increasing friction between sitting partition of user and the seat surface.

In this way comfort sitting and perception of security are increased. Bottom panel 22 serves as counterpart to top panel 21, in order to hold top panel 21 firmly in the requested position with the aid of elastic strings 23. Panels 21 and 22 are identical and thus interchangeable. These panels 21, 22 are preferably 21, 22 are preferably made of textile cloth thus allowing for fast evaporation of moisture. Strings 23 are preferably made of rubber or similar elastic material. The strings 23 can be made of one piece and tied together at the end, or made of several pieces, the pieces having, for example hooks at both ends.

Panels 21 and 22 are equipped, for example, with reinforced holes 24 serving as guides and fastening device for strings 23.

Accordingly, the ergonomic seating unit of the present invention is provided with an entirely mobile seat that promotes active sitting and a stationary frame that promotes stability for the user. The seating unit is designed in such a way that it offers an anatomically correct active sitting position. The seating unit further allows for comfortable and stable sitting and can be adjusted according to the measures of the individual user.

By sitting on a soft surface of the seat of the ergonomic seating unit of the present invention, blood circulation in the legs is optimal. With elbows resting on the armrest and at the same time providing a mobile seat partition, the relaxation of the back, shoulder and neck partition of the user is secured. The seating unit of the present invention is uniquely differentiated from other existing seating units by the fact that it provides a secure and absolutely new sensation of sitting.

What I claim is:

1. An ergonomic seating unit for promoting active sitting, the seating unit comprising:

a substantially spherical-shaped, fluid filled, deformable balloon forming a flexible, mobile seat which conforms to a shape of a user when sat upon; and a main frame for loosely containing the flexible balloon within the main frame, the flexible balloon being freely removable from the main frame when the seating unit is unoccupied and being moveably wedged in place by the main frame when the seating unit is occupied, wherein the main frame comprises:

a lower frame;

an substantially U-shaped upper frame; and at least three vertical connecting tubes for connecting the lower and upper frames to one another, to create a space, in which the mobile seat is placed;

wherein, when the deformable balloon is sat upon by the user, the balloon expands outwardly and is wedged in place in the space formed by the vertical connecting tubes; and wherein, when the deformable balloon is unoccupied by the user, the balloon assumes a substantially ball-shape and is unrestrained by the vertical connecting tubes.

2. An ergonomic seating unit according to claim 1, wherein the lower frame is provided with castors.

3. An ergonomic seating unit according to claim 2, wherein the lower frame is provided with at least five castors.

4. An ergonomic seating unit according to claim 2, wherein at least one of the castors is provided with a brake.

5. An ergonomic seating unit according to claim 2, wherein the lower frame is provided with at least five glides.

6. An ergonomic seating unit according to claim 1, wherein the lower frame is provided with glides.

7. An ergonomic seating unit according to claim 1, wherein at least a portion of the U-shaped upper frame is covered by a padded cover.

8. An ergonomic seating unit according to claim 7, wherein the padded cover comprises one of leather, of a textile or plastic material, and wherein the padded cover comprises a hollow tube having a slit extending along a longitudinal length thereof so that the padded cover can be slipped onto and off the U-shaped upper frame.

9. An ergonomic seating unit according to claims 8, wherein the padded cover is colored or provided with patterns.

10. An ergonomic seating unit according to claim 1, wherein the U-shaped upper frame forms a backrest and an arm rest of the seating unit.

11. An ergonomic seating unit according to claim 1, wherein the vertical connecting tubes are made of at least two parts and equipped with a telescopic joint between those parts so that the total length of the connecting tubes can be adjusted exactly to the measures of the user.

12. An ergonomic seating unit according to claim 1, comprising a flexible backrest for supporting a back of the user, the flexible backrest being attached to the main frame so as to extend thereabove.

13. An ergonomic seating unit according to claim 12, wherein the flexible backrest comprises an arched support arm for attachment to the main frame, the arm being attached to the arched support of the flexible backrest by an elastic damper.

14. An ergonomic seating unit according to claim 1, further comprising a seat cover for covering the deformable balloon.

15. An ergonomic seating unit according to claim 14, wherein the seat cover is made of one of leather, of a textile or plastic material.

16. An ergonomic seating unit according to claim 15, wherein the seat cover comprises; an upper panel having at least six holes, a lower panel identical to the upper panel, and an elastic string made of at least one piece and equipped with hooks to connect firmly and tightly the upper and lower panels to one another.

17. An ergonomic seating unit according to claim 1, wherein the deformable balloon is made of rubber or thermoplastic material.

18. An ergonomic seating unit according to claim 1, wherein the deformable balloon is filled with air and is provided with a removable plug for filling and emptying air from the balloon.

19. An ergonomic seating unit according to claim 1, wherein the main frame is formed of rigid tubes.

* * * * *